United States Patent [19]

Sass et al.

[11] 4,358,344

[45] * Nov. 9, 1982

[54] PROCESS FOR THE PRODUCTION AND RECOVERY OF FUEL VALUES FROM COAL

[75] Inventors: Allan Sass, Los Angeles, Calif.; Harry E. McCarthy, Golden, Colo.; Paul R. Kaufman, North Canton, Ohio; Clement S. Finney, Claremont, Calif.

[73] Assignee: Occidental Petroleum Corporation, Los Angeles, Calif.

[ * ] Notice: The portion of the term of this patent subsequent to May 29, 1990, has been disclaimed.

[21] Appl. No.: 838,841

[22] Filed: Oct. 3, 1977

Related U.S. Application Data

[63] Continuation-in-part of Ser. No. 728,856, Oct. 1, 1976, abandoned, which is a continuation of Ser. No. 534,108, Dec. 18, 1974, abandoned, which is a continuation of Ser. No. 345,090, Mar. 26, 1973, abandoned, which is a continuation-in-part of Ser. No. 57,582, Jul. 23, 1970, Pat. No. 3,736,233.

[51] Int. Cl.[3] ..... C10B 49/16

[52] U.S. Cl. ..... 201/4; 201/8; 201/12; 201/22; 201/36

[58] Field of Search ..... 48/210; 201/4, 8, 12, 201/13, 16, 17, 20–22, 25, 24, 36, 37, 30, 42, 43

[56] References Cited

U.S. PATENT DOCUMENTS

| | | | |
|---|---|---|---|
| 2,608,526 | 8/1952 | Rey | 196/56 |
| 2,709,675 | 5/1955 | Phinney | 202/23 |
| 2,794,725 | 6/1957 | Scharmann | 48/206 |
| 2,824,047 | 2/1958 | Gorin | 202/31 |
| 3,140,242 | 7/1964 | Work | 201/31 |
| 3,375,175 | 3/1968 | Eddinger | 201/31 |
| 3,698,882 | 10/1972 | Garrett | 48/210 |
| 3,736,233 | 5/1973 | Sass | 201/17 |

*Primary Examiner*—Hiram Bernstein
*Attorney, Agent, or Firm*—Forrest E. Logan

[57] ABSTRACT

A method of pyrolyzing and desulfurizing coal in a transport reactor to recover volatile fuel values and hydrogen by heating particulate coal entrained in a carrier gas substantially free of oxygen to a pyrolysis temperature in a zone within three seconds.

73 Claims, 1 Drawing Figure

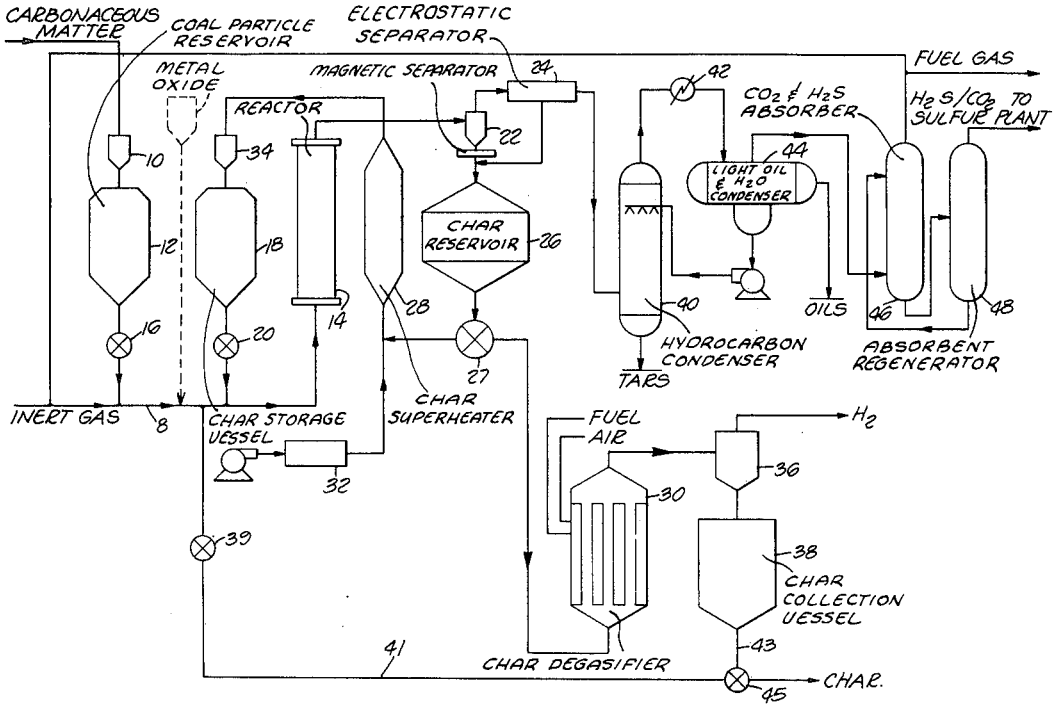

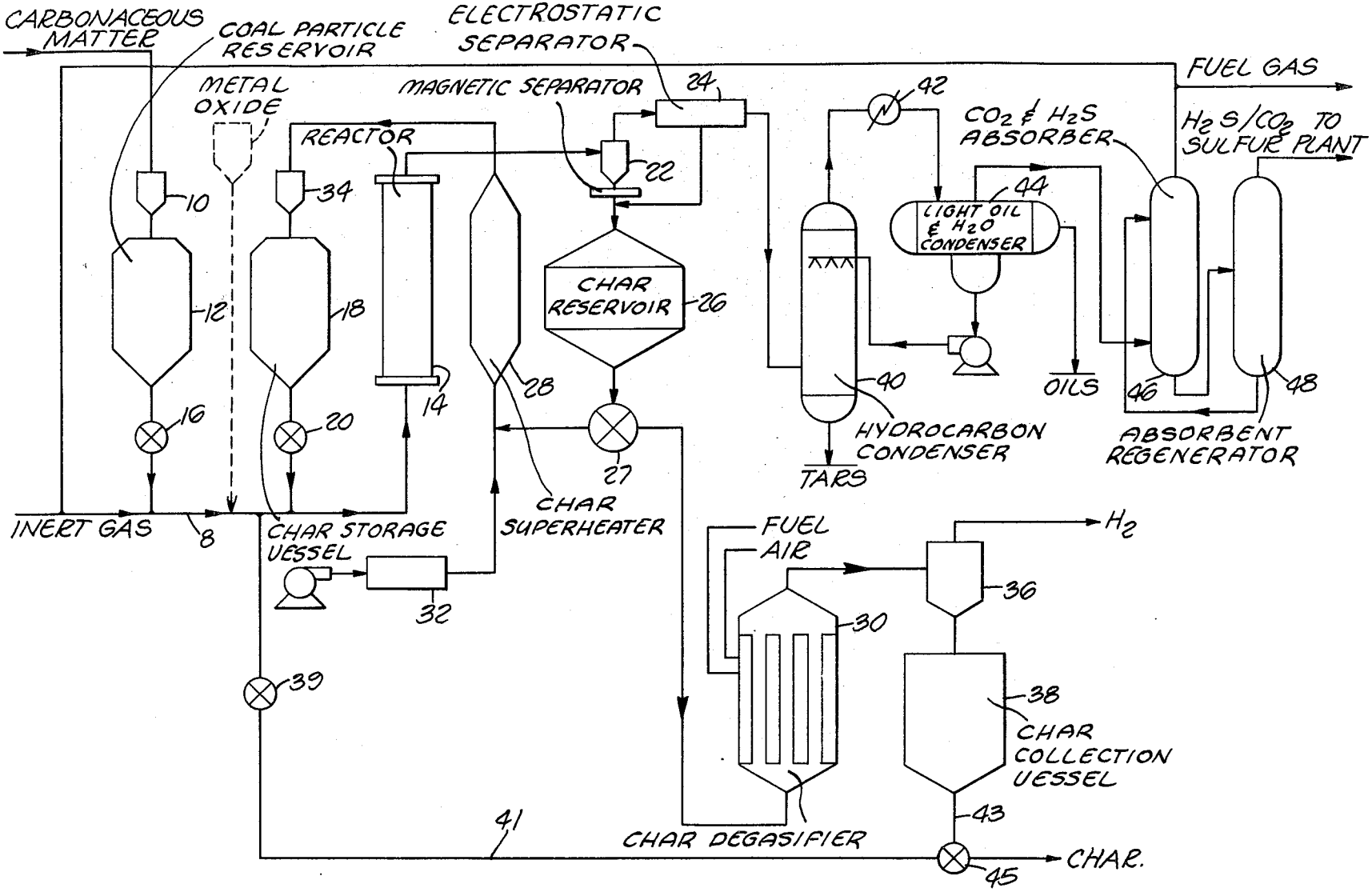
FUEL GAS
$H_2S/CO_2$ TO SULFUR PLANT
48
ABSORBENT REGENERATOR
46
$CO_2$ & $H_2S$ ABSORBER
44
LIGHT OIL & $H_2O$ CONDENSER
OILS
42
40
HYDROCARBON CONDENSER
TARS
24
ELECTROSTATIC SEPARATOR
22
MAGNETIC SEPARATOR
26
CHAR RESERVOIR
27
CHAR SUPERHEATER
28
REACTOR
14
34
18
20
CHAR STORAGE VESSEL
32
39
COAL PARTICLE RESERVOIR
METAL OXIDE
10
12
16
8
CARBONACEOUS MATTER
INERT GAS
$H_2$
36
38
CHAR COLLECTION VESSEL
43
45
CHAR.
30
FUEL
AIR
CHAR DEGASIFIER
41

PROCESS FOR THE PRODUCTION AND RECOVERY OF FUEL VALUES FROM COAL

This is a continuation-in-part application of U.S. application Ser. No. 728,856 filed Oct. 1, 1976 entitled A PROCESS FOR THE TREATMENT OF COAL, now abandoned, which was a continuation application of U.S. application Ser. No. 534,108 filed Dec. 18, 1974, abandoned, which was a continuation application of U.S. application Ser. No. 345,090 Mar. 26, 1973, abandoned, which was a continuation-in-part application of U.S. application Ser. No. 57,582, filed July 23, 1970, now U.S. Pat. No. 3,736,233.

BACKGROUND OF THE INVENTION

The use of fluidized systems wherein a fluidized stream is formed of finely divided coal particles, heated coke particles and a carrier stream to pyrolyze the coal particles to extract the volatiles therefrom is well known in the art. In such prior art processes the heated coke particles and/or the gas stream are utilized to provide the requisite heat of pyrolysis to the coal particles with a supply of coke continuously being produced upon pyrolysis of the coal in the system. Such systems are ideally suited to the production of coke from coal, since they are continuous processes, requiring relatively low capital outlays and can process large volumes of coal cheaply. Exemplary of such type processes is that disclosed in the U.S. Pat. No. 2,608,526 entitled "Coking of Carbonaceous Fuels" issued to W. A. Rex on Aug. 26, 1952.

However, when such prior art processes have been applied to agglomerative bituminous coal, problems have arisen due to the agglomerative nature of such coal. The agglomeration of the coal particles causes severe blockages in the system and renders the system inoperable. In recognition of the severity of this problem, the inventors in the U.S. Pat. No. 2,955,077 entitled "Fluidized Carbonization Process for Agglomerative Coals" issued to J. H. Welinsky, Oct. 4, 1960 and U.S. Pat. No. 3,375,175 entitled "Pyrolysis of Coal" issued to R. T. Eddinger, Mar. 26, 1968 disclose the use of a pretreatment of particulate agglomerative coal to lessen the deleterious effects of agglomeration. In these processes the agglomerative particulate coal is preheated in a conventional fluidized bed at temperatures ranging from 600° F. to 825° F. for periods ranging from 1 to 30 minutes to remove at least a portion of the volatiles from the coal so that the coal can be further pyrolyzed to recover the volatiles therefrom. The requirement of preheating agglomerative bituminous coals in these processes for relatively long residence times imposes severe economic limitations on these processes.

SUMMARY OF INVENTION

This invention discloses a continuous process for the pyrolysis of coal to recover the volatiles therefrom comprising forming a high velocity stream composed of particulate coal, particulate char and a carrier gas substantially free of oxygen in a pyrolysis zone, such that the char and coal particles are intimately admixed and entrained within the gaseous portion of the stream, the solids content of said stream in the zone ranging from about 0.1 to about 10.0 percent by volume based upon the total volume of the stream, said stream at its initiation being made up of from about 5 to about 66 parts by weight of particulate coal based upon the total weight of the coal and char being utilized in forming the stream and from about 95 to 34 parts by weight of particulate char based upon the total weight of the coal and char being utilized in forming the stream. The particulate coal has a particle size of less than 14 mesh and an initial temperature of less than 300° F., and the particulate char has a particle size of less than 14 mesh and an initial temperature ranging from about 1000° F. to the melting temperature of the char ash which lies in the range of from about 1600° F. to about 2800° F. The stream is passed through a pyrolysis zone. The residence time of said stream in the pyrolysis zone is from about 0.01 to about 3 seconds, preferably from about 1 to about 2 seconds, wherein the particulate coal is heated to a temperature ranging from about 900° F. to about 1400° F. The products produced in the pyrolysis zone are removed from the pyrolysis zone with the gaseous stream and the char particles are separated from the carrier gas and volatilized fuel values produced upon pyrolysis of the coal.

In addition to the process for recovery of volatiles from coal, we have also discovered that sulfur in coal can be readily removed when coal is treated in processes similar to this invention or in similar processes for non-agglomerative coals by the addition of sulfur acceptors, e.g., iron oxides, to the particulate coal prior to processing or by heating the products to high temperatures in the presence of hydrogen upon removal of the products from the pyrolysis zone. Our novel process provides those skilled in the art with an efficient economical one step continuous process for the removal of volatiles from coal with the added advantage of providing an efficient, economical method of desulfurizing coal.

BRIEF DESCRIPTION OF THE DRAWING

The drawing shows in schematic outline an arrangement of equipment for carrying out the novel processes of this invention.

DETAILED DESCRIPTION OF PREFERRED EMBODIMENT

By the term "turbulent gaseous stream" is meant a stream of gas flowing through a pyrolysis zone, e.g., a pipe shaped reactor vessel, wherein the flow is turbulent in nature, e.g., having a Reynolds flow index number greater than 2000. Laminar flow in the pyrolysis zone must be avoided, as such a flow system would tend to severely limit the productivity and rate of heat transfer within the pyrolysis zone. In the normal practice of this invention, the char and coal solids are entrained in a carrier gas to form a turbulent gaseous stream which is introduced into the bottom or top of the pyrolysis vessel wherein the char and coal are rapidly intermixed in the carrier gas and dynamically contacted with each other and blown through the vessel to permit the requisite heat transfer to take place. The heat required to remove the volatiles can be provided all or in part from either the sensible heat in the gas or in the char particles.

The carrier gases found useable in this invention to effectuate the pyrolysis of the coal particles must be nondeleteriously reactive with the coal, char and fuel values extracted from the coal during pyrolysis. This gas stream should be substantially free of air and oxygen as they have a very deleterious effect upon the proportion of fuel values extractable from the coal. Exemplary of gases suitable for use as carrier gases in our invention are nitrogen, argon, $CH_4$, $H_2$, carbon monoxide, carbon dioxide and any other gas which will not deleteriously react with or oxidize the components and products of the process. By the term "substantially free of oxygen" is meant a carrier gas with very little, if any, free oxygen.

It must be understood that this invention is designed for the use of all coals, including anthracite, bituminous, lignite and peat, such coals are well known to those skilled in the art and our invention is meant, of course, to include all these coals. The coal particles found useable in our invention can be prepared by any conventional method which will produce coal particles of the requisite size. Care should be taken to see that the exposure of the coal particles to oxygen sources are minimized to prevent oxidizing of the coal since such exposure will have a deleterious effect on yields from the process. For this reason, we prefer to maintain the coal at temperatures below 300° F. prior to feeding it into the system.

The particulate char is added to the particulate coal in our invention both to prevent agglomeration and to provide at least a portion of the heat required for pyrolysis preferably most if not all the heat. The selection of a particular char-to-coal weight ratio will of course be dependent both upon the heat transfer requisites of the system. Since part of the heat of pyrolysis can be supplied by the carrier gas, the temperature, flow rate and residence time in the reactor must be calculated by well known methods for a particular system. In general for economy's sake we prefer to utilize the char particles for the main source of heat for the pyrolysis due to their density and the beneficial heat transfer coefficients built into the system.

The system is essentially designed to heat the coal particles to a temperature ranging from 900° F. to 1400° F. to remove the maximum amount of volatiles therefrom. The selection of a particular temperature in this range will, of course, be dependent upon the particular coal employed and the residence time of the coal particles in the pyrolysis zone.

The effluent from the pyrolysis zone is composed of char, volatilized fuel values, product gas, and the carrier gas. The char solids can be readily separated therefrom by any conventional solids/gas separator such as a cyclone separator and the like. The volatilized hydrocarbons and carrier gas can be separated and recovered by conventional separation and recovery means.

By the term "volatilized fuel values" as used in this application is meant the product volatiles produced by pyrolysis of the coal and in general these consist of condensable hydrocarbons which may be recovered simply by contacting the product gases with condensation means and noncondensable gases such as methane and other hydrocarbon gases which are not recoverable by ordinary condensation means such as methane, etc. The product gas stream also contains undesirable gaseous products such as $CO_2$, $H_2S$ and water which can be removed from the product gas stream by conventional means such as chemical scrubbing, etc. After the condensable hydrocarbons and the undesirable gaseous products have been removed from the product gases, the scrubbed gases can be utilized as the carrier gas or at least as a portion thereof to contribute to the overall efficiency of the system.

Initially, the system will be started up by using char from other sources, but after operation of the process, the product char can be used as the source of char particles required by the system and will be produced in such excess that they will be readily utilizable in further processing to provide new materials which enhance the total economies of our process such as fuel for use in a power plant or a source of raw materials for the chemical industry.

The excess char particles produced by our novel process can be degasified by heating them to temperatures ranging from about 1200° F. to 1800° F. to yield a hydrogen-rich gas stream which is saleable as a fuel, or can be upgraded into pure hydrogen, or can be used for hydrotreating the heavier volatilized hydrocarbons evolved during pyrolysis.

In general, a portion of the solids produced by the passage of the particulate coal and char through the pyrolysis zone which is not recycled through the pyrolysis zone is heated to a degasification zone in the presence of a carrier gas substantially free of oxygen to a temperature ranging between from about 1200° F. to about 1800° F. to form a hydrogen-rich gas stream. In one embodiment the hydrogen-rich gas stream is utilized as the carrier gas in the gaseous stream introduced into the pyrolysis zone. In another embodiment the volatile fuel values produced upon pyrolysis of coal are catalytically hydrotreated with at least a portion of the hydrogen-rich stream.

Char degasification or devolatilization can be carried out in several ways which, in substance, amounts to indirect or direct heating. In direct heating the char is contacted with sufficient oxygen from a suitable source, such as air, to bring the stream by controlled combustion up to the desired degasification temperature. This can be accomplished in a transport reactor similar to the pyrolysis reactor or in a fluidized bed reactor.

Preferably, the char is degasified by indirect heating which yields an hydrogen-rich gas stream containing more than 50 percent by volume hydrogen and especially preferably 70 or more percent by volume hydrogen. In either case, i.e. direct or indirect heating, the hydrogen-rich gas is produced by heating the char and not by a reaction with the char such as in a steam-carbon reaction. In another embodiment, steam is introduced into the degasification zone and produces additional hydrogen and carbon dioxide by the steam-carbon reaction with the char in the degasification zone. The hydrogen produced by steam-carbon reaction or gasification is contrasted to degasification as described above wherein the hydrogen is evolved from the char by heat.

Returning to indirect heating, this may be accomplished in a reactor similar to a tubular heat exchanger in which the char is blown through the tubes in a dense or dilute phase and fuel is burned with air or another suitable source of oxygen in adjacent tubes to supply the heat required for degasification.

Alternatively, the same result can be accomplished by the combustion of the fuel in tubes located in a fluidized bed of the char. After separating the char from the evolved gases, the char is cooled for ultimate use as a high grade fuel.

Where it is desired to produce a low sulfur char, sulfur reduction may be accomplished during pyrolysis, superheating and/or degasification of the resultant char.

One of the major problems faced in processing coal is the formation of noxious sulfur compounds during processing. We have discovered that our novel process and similar processes can be efficiently and economically adapted to processes for removal of sulfur found in coal.

When coal having substantial amounts of iron pyrites ($FeS_2$) is processed in our invention or similar processes, the ($FeS_2$) is converted due to the heating to pyrrhotite in the char and the pyrrhotite is readily removable from the product solids by magnetic separation means.

Where the coal contains sulfur, from about 1 to about 5 parts by weight of a particulate sulfur acceptor, based upon the total weight of sulfur in the coal, is admixed with the coal prior to forming the gaseous stream. In one embodiment the sulfur acceptor is particulate iron oxide. Still further wherein sulfides of iron are formed during pyrolysis from the sulfur and iron oxide, and the sulfides of iron are magnetically separated from the products produced by the pyrolysis.

Desulfurization during pyrolysis may also be achieved by having a solid sulfur acceptor, such as lime or iron oxide, present in the zone during pyrolysis. Preferably, however, iron oxide is used as the sulfur acceptor. The sulfur combines with the iron oxide to form pyrrhotite. Both iron oxide and pyrrhotite are magnetic and may be removed, in addition to any iron pyrite naturally present, from the product char by magnetic separation. This can conveniently be accomplished with minimum cooling of the char to conserve the heat requirements for processing.

Desulfurization may also be achieved during pyrolysis by enriching the gas stream with hydrogen, preferably part of the hydrogen released during degasification. The hydrogen fed to pyrolysis zone reacts with sulfur to form hydrogen sulfide which is later removed by conventional means such as scrubbing; the hydrogen also enriches the volatilized fuel values. In the preferred embodiment of our invention we use a carrier gas containing at least 20 parts by volume of hydrogen based upon the total volume of carrier gas used.

Desulfurization may also be achieved during subsequent heating of the char by employing as the transport gas a gas enriched with hydrogen. This gas reacts with the sulfur in the char to achieve additional sulfur reduction of the product char. As with desulfurization during pyrolysis, the hydrogen employed may be obtained by the recycle of off gases from char degasification before or after purification.

Where it is desired to recover the sulfur from the product char the char which is already at an elevated temperature is heated to about 2300° to 2800° F. at ambient pressures in the nonoxidizing environment for periods up to about 20 minutes. In one embodiment the solids removed after the pyrolysis are degasified and desulfurized by heating the solids to a temperature ranging between from about 2300° F. to about 2800° F. for a period of time up to about 20 minutes in a carrier gas substantially free of oxygen for a sufficient time to degasify and desulfurize the solids. This results in substantial sulfur reductions from the char. In contrast to this, conventional calcination of petroleum coke requires much higher operating temperatures and longer residence time to achieve effective desulfurization.

When the char is degasified by indirect heating, maintaining pressure at from about 15 to about 100 psia and using a hudrogen-rich transport gas enhances additional sulfur removal during degasification. Under these conditions char can be desulfurized as well as degassed within reactor times of about ten minutes. This desulfurization can be achieved since the inorganic sulfur had been essentially removed by the sulfur acceptor in previous treatment.

A basic system which may be used to carry out the process of this invention is illustrated in the attached drawing. With reference thereto, the particulate coal having a particle size of less than 14 mesh which is fed as such, or after comminution during processing for removal of inherent values such as iron pyrites, to cyclone separator 10 when the particulate carbonaceous matter is separated from its carrier gas which is recycled. The compacted particles enter reservoir 12 for ultimate feeding to reactor 14, the feed to which is controlled by valve 16. The char required for the pyrolysis is stored in vessel 18 and its feed to reactor 14 monitored by control valve 20. Where the char is superheated to provide the heat required for pyrolysis, reservoir 18 is suitably insulated or heated to maintain the char at its preferred feed temperature. Feed from reservoirs 12 and 18 are combined with carrier gas supplied externally, or from another part of the process and fed to reactor 14 through line 8. The pyrolysis zone, that is, the zone where the coal is pyrolyzed commences at the point where the coal is mixed with the hot char and terminates where the char is removed from gaseous stream (see cyclone 22 described below). Reactor 14 is generally a vertical tubular reactor. When processing coal having excessive plasticity it may be helpful to use a reactor having porous walls through which an inert gas is continuously passed to prevent sticking of pyrolyzed particles to the surface of the reactor.

After pyrolysis, the char, volatilized fuel values and inert transport gas are passed to cyclone 22 for separation of solids from the gases. Any fines which pass from cyclone 22 are separated in electrostatic separator 24 for return to the char product which is collected in reservoir 26. Where iron oxide is introduced to the particles in reactor 14 as a sulfur acceptor, there is positioned a magnetic separator either before cyclone separator 22 or between cyclone separator 22 and reservoir 26 as shown.

Separation of the char from the gas is preferably carried out without temperature reduction to conserve the process heat. In addition, reservoir 26 is suitably insulated to prevent heat loss. The char which is collected in reservoir 26 is preferably split into two streams which split can be effectuated and metered by valve 27. One constitutes recycle char and is preferably fed to superheater 28, and the balance fed to degassing unit 30.

Alternatively, all of the char from reservoir 26 may be sent to degassing unit 30 where, as a consequence of degasification, it is heated to or above the temperature required for pyrolysis. A portion is withdrawn as product char and the balance returned to reservoir 36 for ultimate use as inert char in reactor 14.

When the char is passed to superheater 28, it is generally heated to a superheat temperature of from about 1000° F. to the char ash melting temperature which is from about 1600° F. to about 2800° F. Heating may be done directly by contacting the char with ambient or preheated air supplied from preheater 32 and inducing controlled combustion. Heater 28 may be a high velocity reactor similar to pyrolysis reactor 14 or a fluidized bed. It is preferred to conduct heating at a temperature to greater than about 1150° F. since above this temperature, evolution of hydrogen from the char is initiated and the hydrogen essentially lost as it is greatly diluted by the combustion gases.

Heated char is then passed to cyclone 34 for solids-gas separation and to high temperature char reservoir 18.

The balance of the char removed from collector 26 is pyrolyzed char and is passed to degasifier 30, shown here as a reactor in which the char is passed in indirect contact with hot products of combustion and raised to a temperature of from about 1200° F. to 1800° F. to dehydrogenate the char. The char and the hydrogen-rich gas then pass to cyclone separator 36 for solids-gas separation.

The hydrogen stream is passed to purification operations for removal of hydrogen-sulfide and carbon dioxide to generate a hydrogen stream suitable for use as a fuel for hydrogenation of hydrocarbons, and desulfurization of the char.

Char is collected in vessel 38 and can be removed therefrom through line 43 and valve 45 for ultimate use as a fuel for power plants or for use as char in pyrolysis portion of the system by being metered into the inert gas stream through line 41 and valve 39. Preferably, the char is cooled in several stages after degasification and before passage to storage. The char may, for instance, be cooled to 1000° to 1200° F. by contact with water or steam to generate, by reaction, additional hydrogen and carbon monoxide and/or carbon dioxide.

The gaseous stream from electrostatic precipitator 24 is passed to a first condenser 40 where it is brought into contact with a water spray to generally cool it to about 500° F. for condensation of heavy hydrocarbons and tar-like products which are separated from the gas stream. The gas stream is then passed through waste heat boiler 42 and into a second condenser 44 where lighter oils and water are condensed and separated into an oil phase and water phase. The water is recycled to condenser 40 and the oil decanted at the interface for recovery and sale or, where desired, for the processing.

The residual gas stream is then passed to absorber 46 where it is brought into contact with conventional absorbents for carbon dioxide and hydrogen sulfide. The pregnant absorbent is then passed to regenerator 48 where the hydrogen sulfide and carbon dioxide are separated to permit absorbent recycle.

Hydrogen sulfide and carbon dioxide are then preferably passed to a sulfur unit such as a Claus-type furnace for conversion to sulfur. The effluent gases from absorber 46 are then sold as product fuel gas or all or a portion of the effluent returned to the system as inert transport gas.

This process has many advantages over the prior art coking and destructive distillation processes, such as economics, no pollution problems and low cost capital outlay and maintenance costs for the process plant. However, the principal economic advantage of the present process lies in the fact that the process can obtain high liquid fuel value yields from coal (up to 40% by weight liquid fuel values based on the weight of the feed coal).

EXAMPLE 1

The following example is given to illustrate the practice of our invention. Commercial nitrogen was utilized as the carrier gas to pass the agglomerative bituminous coal and char through the pyrolysis zone. The zone consisted of a pipe 10 feet long having an inside diameter of 1 inch which was wrapped in electrically powered heating units to provide the heat for pyrolysis. 2.3 pounds per hour of mixture of char and coal particles having a maximum particle of 25 microns and a weight ratio of 3 parts char solids to one part coal solids.

The solids were heated to a temperature of 1025° F. in the pyrolysis zone. The flow rate of nitrogen through the zone during pyrolysis was maintained at 14 standard cubic feed per minute.

The system was operated for a period of one hour and both the product and the system were monitored to check for any deleterious effects arising due to agglomeration of the coal in the system. Minimal effects were noted but were so small as to permit the process to be carried out indefinitely without requiring steps to be taken to clean the pyrolysis zone. In fact the gas pressure differential drop in the pyrolysis zone was less than 0.2 inch of water during the course of the experiment.

The yield of liquid hydrocarbons was equal to 37.9 percent of the initial dry weight of the coal. By comparison, the Fischer assay test (United States Bureau of Mines Publication 638, pages 47 through 56—1967) for the coal yield only 15.7 percent by weight of liquid hydrocarbons.

EXAMPLE II

The following illustrates the desulfurization of coal chars which had been degasified at 1600° F. Two char samples were passed to a thermal desulfurization zone at respective temperatures of 2540° F. and 2740° F. The sulfur content of the product char as a function of residence time in the desulfurization process is shown in Table 2.

TABLE 2

| Time, minutes | 2540° F. | 2740° F. |
|---|---|---|
| | Sulfur content of char, wt. % | |
| 0 | 2.75 | 4.00 |
| 3 | 1.80 | 1.55 |
| 10 | 1.55 | 1.00 |
| 20 | 1.37 | 0.77 |

EXAMPLE III

This example is given to show the effectiveness of magnetic treatment of char to remove sulfur.

In this example, samples of the unpyrolyzed coal and pyrolyzed char from Example I having a maximum particle size of 25 microns was run through a roll type high intensity magnetic separator. The magnetic separator was a model 127, high intensity induced roll magnetic separator produced by Carpco Research and Engineering Corporation run under test operating conditions of 3.0 amperes, with a splitter setting of 0, a drum speed setting of 80, a separation gap between rotor and magnet of $\frac{1}{8}$ inch and a particulate coal or char feed rate of 2.6 grams per minute.

The initial sulfur content of the unpyrolyzed particulate coal was 2.55 percent and the sulfur content of this particulate coal after it had been passed through the magnetic separator was 2.56% the initial sulfur content of the pyrolyzed char produced in Example I was 2.57% and after the char particles had been passed through the magnetic separator the desulfurized char had a sulfur content of 2.01%.

It will be obvious to those skilled in the art that our novel process provies an efficient economical process for lowering the sulfur content of coal.

We have discovered that the yields of volatilized hydrocarbons from agglomerative bituminous coals which are produced in our process are relatively sensitive to the pyrolysis temperature, and is optimum of 1025° F. At this temperature approximately 36 percent by weight of the coal is converted to volatilized hydrocarbons. This represents a yield of synthetic crude oil of almost two barrels per ton of coal after hydrogenation, which is significantly greater than other conventional processes. The volatilized hydrocarbons produced in our process are much richer in the valuable low boiling compounds than tars produced in conventional processes. For example, about 20 percent of the volatilized hydrocarbons have a boiling point below 400° F.

All percentages in Example III are by weight unless otherwise specified.

EXAMPLE IV

Hamilton coal containing about 38% volatiles (Fischer analysis) is ground to a mesh size of less than 100 microns. The coal had the following elemental analysis by weight:

C—73.55%
H—4.97%
O—8.73%
N—1.5%
S—2.75%
Ash—8.50%

The coal was pyrolyzed according to the process of the present invention using a nitrogen gas carrier gas and heated char of less than 100 microns size. The coal was pyrolyzed at a temperature of 1075° F. with a residence time of about 1.5 seconds. The pyrolysis product consisted of 58.7% char, 33% condensable volatilized fuel values, 6.6% product gas and 1.7% water by weight. The elemental analysis for the char, gas, condensable volatilized fuel values are given in the following table.

TABLE 3

| | Weight Percentage | | | | | |
|---|---|---|---|---|---|---|
| | C | H | O | N | S | Ash |
| Condensable Volatilized Fuel Values | 80.3 | 7 | 9.2 | 1.4 | 2.1 | — |
| Char | 74.5 | 2.4 | 4.6 | 1.5 | 2.5 | 14.5 |
| Product Gas | 50.8 | 15.5 | 22.2 | 3 | 8.5 | — |

Each ton of coal yielded 2573 cubic feet of gas which had the following analysis:

TABLE 4

| Volume | $H_2$ | $CH_4$ | $C_2H_6$ | $C_3H_8$ | $H_2S$ | CO | $CO_2$ | $NH_3$ | $N_2$ |
|---|---|---|---|---|---|---|---|---|---|
| % of gas composition | 25 | 42.5 | 4.5 | 4.0 | 5.0 | 5.0 | 10.5 | 0.7 | 1.7 |

EXAMPLE V

A liquefied fraction from the pyrolysis of coal according to the present invention (Hamilton Coal) is characterized according to the following method. The liquefied fraction was diluted with about 1.5 volumes of acetone and dispersed in 40 volumes of hexane to form two fractions. The mixture was boiled to remove the acetone (azeotrope). The hexane fraction was decanted from the resulting aqueous fraction and filtered. The aqueous fraction represented 10% by volume of the original liquid fraction. The hexane-soluble filtrate represented 52.5% of the original organic fraction and the hexane-soluble solids represented 38.5% of the original organic fraction. The hexane-soluble fraction was then treated to isolate the non-polar neutral substances, the polar neutral substances, the phenolic substances and the acid substances. The solid fraction was dispersed in acetone to form an acetone soluble fraction and an acetone insoluble fraction. The elemental analysis of the different fractions is given below:

| | NON-POLAR NEUTRALS 39% | POLAR NEUTRALS 7.2% | PHENOLICS 5.6% | ACIDS 0.8% | ACETONE SOLUBLE 37.2% | ACETONE INSOLUBLE 1.3% |
|---|---|---|---|---|---|---|
| %C | 86.4 | 79.6 | 78.5 | — | 73.4 | 57.3 |
| %H | 8.9 | 7.3 | 6.8 | — | 6.0 | 4.4 |
| %N | 0.73 | 0.34 | 0.30 | — | 1.85 | 2.25 |
| %S | 1.69 | 1.21 | 1.25 | — | 1.59 | 2.03 |
| %O (diff) | 2.3 | 11.6 | 13.1 | — | 17.2 | 34.0* |

*Probably Includes Ash

The liquid fraction of the present invention is a complex mixture of many organic chemicals. Depending upon the process conditions and the starting coal, the liquid fraction generally has the following characteristics: solubility of hexane is from about 50% to about 99%; its solubility in benzene is about 10 to about 99%; its solubility in quinoline is from about 95 to about 100%.

It appears that the liquid contains less than about 1.5% of any single compound. The asphaltene content is from about 10 to about 20%. The hydrogen-carbon mole ratio is from about 1.11 to about 1.14. The viscosity of the material is about 1000 SFS (about 120° F.) to about 73 SFS (about 180° F.). The density varies from about 1.11 to about 1.08 gr/cc over the range of about 70° F. to about 180° F. respectively. The liquid fraction is sensitive to oxidation at ambient temperatures and tends to polymerize in the presence of oxygen. Under an inert gas atmosphere, it is thermally stable up to about the boiling point of water. It tends to undergo thermal cracking at temperatures over 250° F. The elemental analysis of the liquid fraction is as follows: about 75 to about 80% is carbon; about 7 to about 8% is hydrogen; about 0.95% to about 1.1% is nitrogen; about 9 to about 15% is oxygen; about 1.5% to 2.5% is sulfur. About 5% of the liquid fraction is soluble in a bicarbonate solution and about 25% of the fraction is soluble in sodium hydroxide. This latter figure indicates that the liquid values contain more phenolic compounds than carboxylic compounds.

All percentages in Example V are by weight unless otherwise specified.

EXAMPLE VI

Coal of the following analysis was treated to the present process:

| Feed Coal | | | |
|---|---|---|---|
| Proximate Analysis Weight %, Dry Basis | | Ultimate Chemical Analysis | |
| Fixed Carbon | 50.5% | C | 73.6% |
| Volatile Matter | 41.0% | H | 5.0% |
| Ash | 8.5% | O | 8.7% |

-continued

| Feed Coal | | |
|---|---|---|
| | N | 1.5% |
| | S | 2.8% |
| | Ash | 8.5% |
| Fischer Assay, 500° C. | | |
| Liquid Values | 16.3% | |
| Char Values | 69.3% | |
| Gas Values | 5.0% | |
| Water | 9.4% | |
| | 100.0% | |

The coal was ground to minus 14 mesh and pyrolyzed as described herein at a temperature of 1080° F. (residence time approximately 0.1 second) to yield the products described below.

| Pyrolysis Yield, Wt. % | | | |
|---|---|---|---|
| | Char | 56.7 | |
| | Tar | 33.0 | |
| | Gas | 6.6 | |
| | Water | 1.7 | |
| Char Composition % | | Gas Composition, Vol. % | |
| C | 74.5 | $H_2$ | 25.0 |
| H | 2.4 | $CH_4$ | 42.3 |
| O | 4.6 | $C_2H_6$ | 5.6 |
| N | 1.4 | $C_3H_8$ | 4.0 |
| S | 2.6 | CO | 4.9 |
| Ash | 14.5 | $CO_2$ | 10.6 |

All percentages in Example VI are by weight unless otherwise specified.

EXAMPLE VII

A sample of char (prepared from coal at 1000° F.) was devolatilized at 1600° F. in a furnace for 45 minutes and the off gases were collected into a bottle connected to a manometer. The amount of gas evolved was calculated from the change in pressure of the system; however, no material balance was possible since the sample release valve on the furnace did not release all of the char. The gases identified from the devolatilization are hydrogen, carbon monoxide, carbon dioxide, nitrogen, oxygen, hydrogen sulfide, ethylene, ethane and methane. There was one gas separated which was not identified.

Analysis of the devolatilization gas was as follows:

| Component | Vol. % |
|---|---|
| $H_2$ | 64 |
| $CO_2$ | 2.4 |
| $N_2$ | 2-3 (1) |
| CO | 13.5 (1) |
| $CH_4$ | 7.4 |
| $H_2S$ | >3 (1) |
| Ethylene | <0.1 (1) |
| Ethane | <0.1 (1) |
| $O_2$ | — |
| Unknown | — |

(1) estimated

The char in this example was prepared from Uniontown Run-of-Mine (ROM) Coal screened to a −8 Mesh, +14 Mesh size.

EXAMPLE VIII

Samples of char prepared by pyrolysis of ROM Hamilton Coal (Western Kentucky No. 9 Seam) at 1000° F. were screened to −8 Mesh, +14 Mesh size and devolatilized under vacuum. From plots of change in pressure versus time and reaction temperature versus time, it was concluded that the rate of gas evolution is dependent upon the rate of temperature equilibration of the sample. The volume of gas evolved during each test was calculated from the change in pressure. The results were as follows:

| Devolatilization of Char as Function of Temperature | | | |
|---|---|---|---|
| Sample No. | Devolatilization Temperature, °F. | Sample Size gm | Vol. Gas Evolved ($Ft^3$/Ton of char) |
| 1 | 1700 | 50.15 | 7169 (2) |
| 2 | 1600 | 49.47 | 6974 (2) |
| 3 | 1500 | 49.67 | 6084 (2) |

(2) calculated

The percentage weight losses during the devolatilization of the char samples was as follows:

1500° F.—13.63%,
1600° F.—13.97%, and
1700° F.—13.82%.

These losses are in close agreement with the volatile matter content of the starting char, which was determined to be 13.26%.

The devolatilization gas was analyzed in a gas chromatograph and the results were as follows:

| Off-Gas Composition From Char Devolatilization | | | |
|---|---|---|---|
| Devolatilization | Volume Percentage | | |
| Temperature Component | 1700° F. Sample No. 1 | 1600° F. Sample No. 2 | 1500° F. Sample No. 3 |
| $H_2$ | 67.6 | 64.8 | 61.8 |
| $CO_2$ | 4.0 | 3.7 | 3.6 |
| $N_2$ | 1.2 | 2.5 | 4.0 |
| CO | 13.5 (1) | 12.5 | 13.0 |
| $CH_4$ | 12.0 (1) | 9.0 | 9.0 |
| Ethylene | 0.05 (1) | 0.07 | 0.1 |
| Ethane | 0.2 (1) | 0.2 | 0.2 |
| $H_2S$ | 2.15 | 2.25 | 2.35 |
| $H_2O$ | — | — | — |
| $O_2$ | — | — | — |

(1) estimated

EXAMPLE IX

Thermal Desulfurization of Char

A char was heated to 2690° F. under vacuum. After 85 minutes of heating, the sulfur content was reduced from 2.13% to 1.25%. The analysis of the char was as follows:

| | Weight Percentage | |
|---|---|---|
| Component | Char Analysis Before Heating | Char Analysis After Heating |
| C | 81.30 | 89.03 (3) |
| | | 89.28 (3) |
| H | 1.14 | 0.26 (3) |
| | | 0.37 (3) |
| N | 0.36 | 0.30 |
| O | 2.07 | 0 |
| S | 2.13 | 1.25 |
| V.M. (4) | 1.47 | 1.37 |
| Moisture | 0.29 | 0.16 |
| Ash | 12.71 | 10.09 |

(3) Two analyses
(4) Volatile Matter

EXAMPLE X

Samples of char prepared in a muffle furnace at 1000° F. from Hamilton ROM coal were screened to −8 Mesh +14 Mesh and devolatilized under vacuum at temperatures of 775° C., 825° C., 895° C., 925° C. and 1000° C. The off-gases were analyzed and the gas yields estimated. The compositions and yields of the gases were as follows:

| Off-Gas Composition from Char Devolatilization | | | | | |
|---|---|---|---|---|---|
| Devolatilization | Volume Percentage | | | | |
| Temperature | 1000° C. | 925° C. | 895° C. | 825° C. | 775° C. |
| Component | Sample 1 | Sample 2 | Sample 3 | Sample 4 | Sample 5 |
| $H_2$ | 70.0 | 67.6 | 64.8 | 61.8 | 58.0 |
| $CO_2$ | 3.5 | 3.3 | 3.5 | 3.6 | 4.0 |
| $C_2H_4$ | 0.2 | 0.2 | 0.1 | 0.1 | 0.1 |
| $C_2H_6$ | 0.3 | 0.3 | 0.2 | 0.2 | 0.1 |
| $C_3H_6$ | 0.01 (1) | 0.01 | 0.01 | 0.01 | 0.01 |
| $C_3H_8$ | 0.01 (1) | 0.01 | 0.01 | 0.01 | 0.01 |
| $CH_4$ | 10.5 | 10.5 | 10.7 | 14.5 | 14.5 |
| $H_2S$ | 1.9 | 2.15 | 2.25 | 2.35 | 2.40 |
| $N_2$ | 0.8 | 2.0 | 1.5 | 0.8 | 0.8 |
| $O_2$ | — | 0.7 | 0.4 | 0.3 | 0.3 |
| CO | 12.0 | 12.5 | 11.5 | 13.5 | 12.5 |
| $CS_2$ or COS | 20.1 (1) | 20.1 | 20.1 | 20.1 | 20.1 |
| COS or $CS_2$ | 2 (1) | 2 | 2 | 2 | 2 |

(1) estimated

| Gas Yields from Char Devolatilization | | | |
|---|---|---|---|
| Sample No. | Devolatilization Temperature, °C. | % Char Volatilized | Cubic Feet Gas Evolved Per Ton of Char |
| 1 | 1000 | 14.33 | 7649 (2) |
| 2 | 925 | 13.82 | 7169 (2) |
| 3 | 895 | 13.97 | 6974 (2) |
| 4 | 825 | 13.63 | 6084 (2) |
| 5 | 775 | 12.19 | 5294 (2) |

(2) calculated

| Char Devolatilization Analyses (−8 Mesh +14 Mesh) | | | | | | | | | |
|---|---|---|---|---|---|---|---|---|---|
| Sample | Devolatilization | Weight % Component | | | | | | | |
| No. | Temperature | C | H | N | O | S | Moist | Ash | V.M. (4) |
| | | BEFORE DEVOLATILIZATION | | | | | | | |
| | | 64.09 | 2.91 | 1.96 | 2.64 | 3.37 | 0.19 | 24.84 | 13.26 |
| | | AFTER DEVOLATILIZATION | | | | | | | |
| 1 | 1000° C. | 69.43 | 0.51 | 0.92 | 0.15 | 2.74 | 0.38 | 25.87 | 1.05 |
| 2 | 925° C. | 70.17 | 0.95 | 1.09 | 0.79 | 2.61 | 0.50 | 23.89 | 2.54 |
| 3 | 895° C. | 69.73 | 1.04 | 1.10 | 0.46 | 2.62 | 0.52 | 24.53 | 3.80 |
| 4 | 825° C. | 70.62 | 0.99 | 1.22 | 0.12 | 2.38 | 0.12 | 24.22 | 2.08 |
| 5 | 775° C. | 68.56 | 1.20 | 1.26 | 0 | 2.41 | 1.09 | 25.55 | 3.19 |

(4) Volatile Matter

EXAMPLE XI

Samples of −200 Mesh char produced in a one-inch diameter transport (or transfer line) reactor were devolatilized and the off-gas compositions were analyzed and gas yields estimated by calculation.

No hydrogen sulfide was found in the off-gas.

| Off-Gas Composition from Devolatilization of −200 Mesh Char | | | |
|---|---|---|---|
| Devolatilization | Volume Percentage | | |
| Temperature | 925° C. | 920° C. | 900° C. |
| Component | Sample 1 | Sample 2 | Sample 3 |
| $H_2$ | 62.5 | 63.5 | 61 |
| $CO_2$ | 3.2 | 4.1 | 3.5 |
| $C_2H_4$ | 0.5 | 1.4 | 1.5 |
| $C_2H_6$ | 0.2 | 0.4 | 0.3 |
| $C_3H_6$ | <0.1 (1) | <0.1 | <0.1 |
| $C_3H_8$ | <0.1 (1) | <0.1 | <0.1 |
| $N_2$ | 5 | 4 | 6 |
| $O_2$ | 1 | 0.6 | 1.5 |
| CO | 20 | 18 | 18.5 |
| $CH_4$ | 5.3 | 6.2 | 6.7 |
| $CS_2$ or COS | <0.1 (1) | <0.1 | <0.1 |
| COS or $CS_2$ | 3 | 3 | 3 |

(1) estimated

EXAMPLE XI (Continued)

| Gas Yields from Char Devolatilization of −200 Mesh Char | | | |
|---|---|---|---|
| Sample No. | Devolatilization Temperature | Cubic Feet Gas Evolved Per Ton of Char | % Char Volatilized |
| 1 | 925° C. | 4966 (2) | 8.85 |
| 2 | 920° C. | 4530 (2) | 6.93 |
| 3 | 900° C. | 3844 (2) | — |

(2) calculated

EXAMPLE XII

Thermal Desulfurization

Samples of char prepared from Hamilton ROM coal at 1600° F. in a muffle furnace and screened to −8 Mesh, +14 Mesh, were thermally desulfurized at 1370°, 1435°, and 1500° C. The off-gases were analyzed and the gas yields were estimated. The results were as follows:

Off-Gas Composition from Thermal Desulfurization

| Desulfurization Temperature | Volume Percentage | | |
|---|---|---|---|
| Component | 1500° C. Sample 1 | 1435° C. Sample 2 | 1370° C. Sample 3 |
| $H_2$ | 60.5 | 61.0 | 62.5 |
| $CO_2$ | 1.6 | 1.7 | 2.1 |
| $H_2S$ | 1.35 | 1.0 | 0.75 |
| $N_2$ | 7.0 | 7.5 | 7.5 |
| CO | 25 | 25 | 23 |
| $CH_4$ | 0.2 | 0.2 | 0.5 |
| $CS_2$ or COS | <0.1 (1) | <0.1 | <0.1 |
| COS or $CS_2$ | 4 (1) | 4 | 4 |
| Unknown | — | — | — |

(1) estimated

EXAMPLE XII (Continued)

Gas Yields from Thermal Desulfurization

| Sample No. | Desulfurization Temperature | Cubic Feet of Gas Evolved Per Ton of Char | % Char Volatilized |
|---|---|---|---|
| 1 | 1500° C. | 4450 (2) | 14.82 |
| 2 | 1435° C. | 3836 (2) | 11.21 |
| 3 | 1370° C. | 3220 (2) | 8.72 |

(2) calculated

The sulfur content of the char was reduced from 2.98% as follows:

| Sample No. | Desulfurization Temperature | % Sulfur After Treatment |
|---|---|---|
| 1 | 1500° C. | 1.84 |
| 2 | 1435° C. | 2.18 |
| 3 | 1370° C. | 2.48 |

In these tests, the char was dropped into a heated furnace at the reaction temperature and was kept at this temperature until the pressure stopped changing. The furnace was then disconnected and allowed to cool with the char remaining in the furnace. The times for heating of the char were 30 minutes at 1500° C., 28 minutes at 1435° C. and 25 minutes at 1375° C. The cooling periods were approximately 3 hours.

EXAMPLE XIII

Char produced from Hamilton Coal was heated for various times at 2590° F. The sulfur content was reduced from 3.68%:

to 3.58% in 1 minute,
to 3.04% in 3 minutes,
to 2.72% in 5 minutes,
to 2.18% in 10 minutes,
to 1.84% in 20 minutes, and
to 1.42% in 60 minutes.

These reductions in sulfur closely resemble the results in Example XII, even though in this example, the desulfurization was conducted under a nitrogen purge, while Example XII was conducted under a vacuum.

EXAMPLE XIV

A sample of −200 Mesh char prepared at 950° F. in the one-inch transport (transfer line) was devolatilized at a temperature of 688° F. The off-gas had a calculated yield of 4040 cubic feet per ton of char.

Gas Chromatographic Analysis of the Off-Gas

| Component | Vol. % |
|---|---|
| $H_2$ | 61.5 |
| $CO_2$ | 3.4 |
| $C_2H_4$ | 0.65 |
| $C_2H_6$ | 0.65 |
| $C_3H_6$ | 0.5 |
| $C_3H_8$ | 0.3 |
| $N_2$ | 4 |
| $O_2$ | 0.8 |
| CO | 16 |
| $CH_4$ | 13 |
| $CS_2$ or COS | <0.1 (1) |
| COS or $CS_2$ | 3 (1) |

(1) estimated

EXAMPLE XV

Elemental analysis and sulfur form analysis of −200 Mesh char, which was produced in a one-inch diameter transport (transfer line) reactor, before devolatilization and after devolatilization were as follows:

Elemental Analysis

| Sample No. | Pyrolysis Temperature, °F. | Devolatilization Temperature, °F. | State | Weight % C | H | N | O | S | V.M. (4) | Moist | Ash |
|---|---|---|---|---|---|---|---|---|---|---|---|
| 1 | 1090 | — | Before | 67.28 | 2.00 | 1.86 | 3.90 | 3.16 | 10.27 | 0.94 | 20.86 |
| 1 | 1090 | 1697 | After | 68.31 | 0.97 | 1.04 | 1.15 | 3.19 | 1.84 | 0.32 | 25.02 |
| 2 | 1025 | — | Before | 70.73 | 2.25 | 1.52 | 5.91 | 2.49 | 9.83 | 0.04 | 17.54 |
| 2 | 1025 | 1688 | After | 75.03 | 0.90 | 0.86 | 1.03 | 2.24 | 2.11 | 0.82 | 19.12 |
| 2 | 1025 | 1652 | After | 71.84 | 1.72 | 1.09 | 3.07 | 2.55 | 3.85 | 0.23 | 19.50 |

(4) Volatile Matter

Sulfur Form Analysis

| Sample No. | Pyrolysis Temperature, °F. | Devolatilization Temperature, °F. | State | Weight % Pyritic | Sulfate | Sulfide | Organic | Total Sulfur |
|---|---|---|---|---|---|---|---|---|
| 1 | 1090 | — | Before | 0.88 | 0.17 | 0.76 | 1.25 | 3.06 |
| 1 | 1090 | 1697 | After | 0.13 | 0 | 1.68 | 1.32 | 3.13 (3)<br>3.19 (3) |

(3) two analyses

EXAMPLE XVI

Hamilton ROM Coal −8 Mesh, +16 Mesh was converted to char and the char was devolatilized at 1600° F. The devolatilized char was desulfurized at the three temperatures shown below.

Analysis of the devolatilized char (Before) and the desulfurized char (After) was as follows:

| State | Desulfurization Temp., °F. | Weight % C | H | N | O | S | Moist | V.M (4) | Ash |
|---|---|---|---|---|---|---|---|---|---|
| Before | — | 66.59 | 1.71 | 1.10 | 1.77 | 2.98 | 2.0 | 9.10 | 24.8 |
| After | 2498 | 74.10 | 0.16 | 0.31 | 0 | 2.48 | 0.08 | 0.06 | 24.6 |
| After | 2615 | 74.67 | 0.43 | 0.15 | 0 | 2.18 | 0.04 | 0 | 24.6 |
| After | 2732 | 76.78 | 0.12 | 0.13 | 0 | 1.84 | 0 | 0.14 | 23.0 |

Uniontown coal was converted to char and the char was devolatilized at 1600° F. The devolatilized char was then desulfurized at the temperature shown below. Analysis of the devolatilized char (Before) and the desulfurized char (After) was as follows:

| State | Desulfurization Temp., °F. | Weight % C | H | N | O | S | Moist | V.M (4) | Ash |
|---|---|---|---|---|---|---|---|---|---|
| Before | — | 81.30 | 1.14 | 0.36 | 2.07 | 2.13 | 0.29 | 1.47 | 12.7 |
| After | 2693 | 89.15 | 0.31 | 0.30 | 0 | 1.25 | 0.16 | 1.37 | 10.0 |

(4) Volatile Matter

What is claimed is:

1. A process for the pyrolysis of coal to produce volatile fuel values and char therefrom comprising:
   a. continuously introducing into a pyrolysis zone
      i. particulate coal having a particle size less than about 14 mesh,
      ii. heated particulate char at a temperature of between about 1000° F. and the ash softening temperature of said particulate char, and
      iii. a gas,
      substantially without introducing free oxygen into said pyrolysis zone, and maintaining said coal and char in turbulent gas-entrained flow in said pyrolysis zone wherein the parts by weight of said particulate char to the total weight of particulate char and particulate coal being introduced into said pyrolysis zone is such as to permit said particulate coal to be heated within said pyrolysis zone to a temperature of between about 900° F. and about 1400° F. to produce a product stream containing a first gaseous product and a first solid product, said first gaseous product comprising said gas introduced into said pyrolysis zone and volatile fuel values produced from said particulate coal, and said first solid product comprising said particulate char introduced into said pyrolysis zone and a char produced from said coal;
   b. removing said product stream from said pyrolysis zone;
   c. substantially separating said first solid product from said first gaseous product; and
   d. heating at least a portion of said first solid product, before permitting substantial exposure of same to free oxygen, to a temperature of between about 1200° F. to about 1800° F. to evolve a second gaseous product which is a hydrogen-rich gas, and to produce a second solid product.

2. The process of claim 1 wherein said second gaseous product is more than 50 percent by volume hydrogen.

3. The process of claim 1 wherein said second gaseous product contains at least about 70 percent by volume hydrogen.

4. The process of claim 1 further comprising heating at least a portion of said first solid product to a temperature of between about 1000° F. and the ash softening temperature of said first solid product and using said first solid product so heated as said heated particulate char introduced into said pyrolysis zone.

5. The process of claim 1 further comprising returning at least a portion of said second solid product to said pyrolysis zone as said heated particulate char.

6. The process of claim 1 wherein said particulate coal remains within said pyrolysis zone for a period of time of between about 0.01 seconds and about 3 seconds.

7. The process of claim 6 wherein the said period of time is from about 1 to about 2 seconds.

8. The process of claim 1 wherein said particulate coal is introduced into said pyrolysis zone by first entraining said particulate coal in an entraining gas to produce an entrained coal stream and introducing said entrained coal stream into said pyrolysis zone.

9. The process of claim 1 wherein said heated particulate char is introduced into said pyrolysis zone by first entraining said heated particulate char in an entraining gas to produce an entrained heated char stream and introducing said entrained heated char stream into said pyrolysis zone.

10. The process of claim 1 further comprising minimizing the exposure of said particulate coal to oxygen prior to its introduction into said pyrolysis zone.

11. The process of claim 1 further comprising cooling said first gaseous product to produce a condensed product and an uncondensed product.

12. The process of claim 11 further comprising substantially separating said condensed product from said uncondensed product and hydrotreating said condensed product with said second gaseous product.

13. The process of claim 1 further comprising heating at least a portion of said second solid product to a temperature between about 2300° F. and about 2800° F. in a substantial absence of free oxygen to reduce the sulfur content of said second solid product.

14. The process of claim 13 wherein said heating of said second solid product is for a period of time no greater than about 20 minutes.

15. The process of claim 1 wherein said heating of said first solid product is by indirect heating at a pressure above atmospheric in a hydrogen-rich gas.

16. The process of claim 15 wherein said pressure above atmospheric is between about 15 psia and about 100 psia.

17. The process of claim 16 wherein said indirect heating is for a period of time of about 10 minutes.

18. The process of claim 1 further comprising heating said first solid product with a gas enriched with hydrogen to reduce the sulfur content of said first solid product.

19. The process of claim 18 wherein said gas enriched with hydrogen comprises at least in part said second gaseous product.

20. The process of claim 1 wherein said product stream contains sulfides of iron and further comprising magnetically separating said sulfides of iron from said product stream.

21. The process of claim 1 wherein said first solid product contains sulfides of iron and further comprising magnetically separating said sulfides of iron from said first solid product.

22. The process of claim 1 wherein said particulate coal contains sulfur and further comprising admixing between about 1 and about 5 parts by weight, based upon the weight of sulfur in said particulate coal, of a particulate sulfur acceptor with said particulate coal prior to introducing said particulate coal into said pyrolysis zone.

23. The process of claim 22 wherein said sulfur acceptor is iron oxide.

24. The process of claim 23 wherein said product stream contains sulfides of iron and further comprising magnetically separating said sulfides of iron from said product stream.

25. The process of claim 1 wherein said gas introduced into said pyrolysis zone is at least in part a product of said process.

26. The process of claim 1 wherein said gas introduced into said pyrolysis zone is produced at least in part from said first gaseous product.

27. The process of claim 1 wherein said gas introduced into said pyrolysis zone is produced in part from said volatile fuel values.

28. The process of claim 1 further comprising using at least a portion of said second gaseous product as a portion of said gas introduced into said pyrolysis zone.

29. The process of claim 1 wherein a solids content of material in the pyrolysis zone is from about 0.1 to about 10 percent by volume, from about 5 to about 66 parts by weight of solids introduced into the pyrolysis zone is particulate coal, based upon the total weight of the coal and char, and from about 95 to about 34 parts by weight of solids introduced into the pyrolysis zone is particulate char, based upon the total weight of the coal and char.

30. The process of claim 1 wherein a portion of the first solid product produced by passage of the particulate coal and char through the pyrolysis zone is heated to a temperature of from about 1150° F. to about 1600° F. and thereafter is utilized to form a portion of the heated particulate char introduced into the pyrolysis zone.

31. The process of claim 30 wherein the particulate char utilized in the formation of said heated particulate char has a temperature of about 1150° F.

32. The process of claim 1 wherein a solids content of material in the pyrolysis zone is 3 percent by volume.

33. The process of claim 1 wherein an amount of heated particulate char is introduced into the pyrolysis zone which equals 90 parts by weight of char based upon the total weight of particulate coal and char.

34. The process of claim 1 wherein the gas is a hydrogen enriched gas.

35. The process of claim 1 wherein the volatile fuel values produced upon pyrolysis of coal are catalytically hydrotreated with at least a portion of the second gaseous product.

36. The process of claim 1 wherein the particulate coal contains sulfur and the gas contains hydrogen.

37. A process of claim 1 wherein said first solid product is degasified and desulfurized by heating to a temperature ranging between from about 2300° F. to about 2800° F. for a period of time up to about 20 minutes in a carrier gas substantially free of oxygen to degasify and desulfurize the solids.

38. The process of claim 1 wherein the particulate coal is heated to a temperature of from about 900° F. to about 1100° F. in the pyrolysis zone.

39. A process for the pyrolysis of coal to produce volatile fuel values and char therefrom comprising:

a. continuously introducing into a pyrolysis zone
   i. a particulate coal having a particle size less than about 14 mesh,
   ii. a heated particulate char at a temperature of between about 1000° F. and the ash softening temperature of said particulate char, and
   iii. a gas, substantially without introducing free oxygen into said pyrolysis zone, and maintaining said coal and char in turbulent gas-entrained flow in said pyrolysis zone, wherein said particulate coal has a residence time in said pyrolysis zone of between about 0.01 second and about 3 seconds, and wherein the parts by weight of said particulate char-to-the total weight of particulate char and particulate coal being introduced into said pyrolysis zone is such as to permit said particulate coal to be heated within said pyrolysis zone to a temperature of between about 900° F. and about 1400° F. to produce a product stream containing a first gaseous product and a first solid product, said first gaseous product comprising said gas introduced into said pyrolysis zone, and said volatile fuel values produced from said particulate coal, and said first solid product comprising said particulate char introduced into said pyrolysis zone and a char produced from said coal;

b. removing said product stream from said pyrolysis zone;

c. substantially separating said first solid product from said first gaseous product;

d. heating at least a portion of said first solid product, before permitting substantial exposure of same to free oxygen, to a temperature of between about 1200° F. to about 1800° F. to evolve by decomposition of said first solid product a second gaseous product which is a hydrogen-rich gas, and to produce a second solid product;

e. heating at least a portion of said first solid product to a temperature between about 1000° F. and the ash softening temperature of said first solid product and using it as said heated particulate char introduced into said pyrolysis zone;

f. cooling said first gaseous product to produce a condensed product and an uncondensed product; and g. wherein said gas introduced into said pyrolysis zone is at least in part a product of said process.

40. The process of claim 39 wherein said second gaseous product is more than 50 percent by volume hydrogen.

41. The process of claim 39 wherein said second gaseous product contains at least about 70 percent by volume hydrogen.

42. The process of claim 39 further comprising returning at least a portion of said second solid product to said pyrolysis zone as said heated particulate char.

43. The process of claim 39 wherein said particulate coal is introduced into said pyrolysis zone by first entraining said particulate coal in an entraining gas to produce an entrained coal stream and introducing said entrained coal stream into said pyrolysis zone.

44. The process of claim 39 wherein said heated particulate char is introduced into said pyrolysis zone by first entraining said heated particulate char in an entraining gas to produce an entrained heated char stream and introducing said entrained heated char stream into said pyrolysis zone.

45. The process of claim 39 further comprising substantially separating said condensed product from said uncondensed product and hydrotreating said condensed product with said second gaseous product.

46. The process of claim 39 further comprising heating at least a portion of said second solid product to a temperature between about 2300° F. and about 2800° F. in a substantial absence of free oxygen for a period of time no greater than about 20 minutes to reduce the sulfur content of said second solid product.

47. The process of claim 39 wherein said heating of said first solid product is by indirect heating at a pressure between about 15 psia and about 100 psia and for a period of time of about 10 minutes.

48. The process of claim 39 further comprising heating said first solid product with at least a portion of said second gaseous product to produce a char of lower sulfur content than the sulfur content of said first solid product.

49. The process of claim 39 wherein said product stream contains sulfides of iron and further comprising magnetically separating said sulfides of iron from said product stream.

50. The process of claim 39 wherein said first solid product contains sulfides of iron and further comprising magnetically separating said sulfides of iron from said first solid product.

51. The process of claim 39 wherein said particulate coal contains sulfur and further comprising admixing between about 1 to about 5 parts by weight, based upon the weight of sulfur in said particulate coal, of a particulate sulfur acceptor comprising iron oxide with said particulate coal prior to introducing said particulate coal into said pyrolysis zone and magnetically separating said sulfides of iron from said product stream.

52. The process of claim 39 wherein said gas introduced into said pyrolysis zone is produced at least in part from said first gaseous product.

53. The process of claim 39 wherein said gas introduced into said pyrolysis zone is produced in part from said volatile fuel values.

54. The process of claim 39 further comprising using at least a portion of said second gaseous product as a portion of said gas introduced into said pyrolysis zone.

55. The process of claim 39 further comprising separating said condensed product from said uncondensed product, treating said uncondensed product to remove at least a portion of any carbon dioxide and hydrogen sulfide present therein and using said uncondensed product after said treating at least in part as said gas introduced into said pyrolysis zone.

56. A process for the pyrolysis of coal to produce volatile fuel values and char therefrom comprising:

a. continuously introducing into a pyrolysis zone
   i. particulate coal having a particle size less than about 14 mesh,
   ii. heated particulate char at a temperature of between about 1000° F. and the ash softening temperature of said particulate char, and
   iii. a gas, substantially without introducing free oxygen into said pyrolysis zone, and maintaining said coal and char in turbulent gas-entrained flow in said pyrolysis zone wherein the parts by weight of said particulate char-to-the total weight of particulate char and particulate coal being introduced into said pyrolysis zone is such as to permit said particulate coal to be heated within said pyrolysis zone to a temperature of between about 900° F. and about 1400° F. to produce a product stream containing a first gaseous product and a first solid product, said first gaseous product comprising said gas introduced into said pyrolysis zone and volatile fuel values produced from said particulate coal, and said first solid product comprising said particulate char introduced into said pyrolysis zone and a char produced from said coal;

b. removing said product stream from said pyrolysis zone;

c. substantially separating said first solid product from said first gaseous product; and d. heating at least a portion of said first solid product to a temperature of between about 2300° F. and about 2800° F. in a non-oxidizing environment to reduce the sulfur content thereof and to produce a second solid product.

57. The process of claim 56 wherein said heating of said first solid is in the presence of a carrier gas which is substantially free of oxygen.

58. The process of claim 56 wherein said heating of said first solid is for a period of time not greater than about 20 minutes.

59. The process of claim 56 further comprising heating at least a portion of said first solid product to between about 1000° F. and the ash softening temperature of said first solid product and using said first solid product so heated as said heated particulate char introduced into said pyrolysis zone.

60. In a process for the pyrolysis of coal to produce a first char product and a first gaseous product comprising volatile fuel values wherein particulate coal is heated to an elevated temperature with a heated particulate char in a pyrolysis zone which is operated substantially without introducing free oxygen thereto, and wherein said heating is controlled by adjusting the properties of materials introduced to the pyrolysis zone such as the particle size of said particulate coal, the temperature of said heated particulate char, the ratio of particulate coal-to-heated particulate char, and the period of time of heating, the improvement which comprises heating at least a portion of said first char product before permitting substantial exposure of it to a source of free oxygen to a temperature between about 1200° F. and about 1800° F. in a substantial absence of free oxygen to evolve a second gaseous product which is a hydrogen-rich gas, and to produce a second char product.

61. The process of claim 60 wherein said second gaseous product is more than 50 percent by volume hydrogen.

62. The process of claim 60 wherein said second gaseous product contains at least about 70 percent by volume hydrogen.

63. The process of claim 60 further comprising using at least a portion of said second char product as at least a portion of said heated particulate char introduced into said pyrolysis zone.

64. The process of claim 60 further comprising cooling said first gaseous product to produce a condensed product and an uncondensed product, substantially separating said condensed product from said uncondensed product, and hydrotreating said condensed product with said second gaseous product.

65. The process of claim 60 further comprising heating at least a portion of said second char product to a temperature between about 2300° F. and about 2800° F. in a substantial absence of free oxygen to reduce the sulfur content of said second char product.

66. The process of claim 65 wherein said heating of said second char product is for a period of time no greater than about 20 minutes.

67. The process of claim 60 wherein said heating of said first char product is by indirect heating at a pressure above atmospheric in a hydrogen-rich gas.

68. The process of claim 67 wherein said pressure above atmospheric is between about 15 psia and about 100 psia.

69. The process of claim 68 wherein said indirect heating is for a period of time of about 10 minutes.

70. The process of claim 60 further comprising using at least a portion of said second gaseous product to convey particulate material into said pyrolysis zone.

71. The process of claim 60 wherein said heating of said first char product comprises contacting said first char product with said second gaseous product to produce a char of lower sulfur content than the sulfur content of said first char product.

72. The process of claim 60 further comprising introducing said second gaseous product into said pyrolysis zone to hydrotreat materials therein.

73. The process of claim 60 further comprising contacting said first char product with said second gaseous product to reduce the sulfur content of said first char product.

* * * * *